United States Patent [19]

Sérina

[11] 4,364,453

[45] Dec. 21, 1982

[54] SAFETY INSTALLATION FOR ELEVATORS

[76] Inventor: Antoine Sérina, 47 Av-Jeanne d'Arc, 95600 Eaubonne, France

[21] Appl. No.: 210,793

[22] Filed: Nov. 26, 1980

[30] Foreign Application Priority Data

Dec. 7, 1979 [FR] France ..... 79 30068

[51] Int. Cl.[3] ..... B66B 13/24

[52] U.S. Cl. ..... 187/29 R; 187/71

[58] Field of Search ..... 187/27, 29, 71, 72

[56] References Cited

U.S. PATENT DOCUMENTS

| | | | |
|---|---|---|---|
| 1,270,716 | 6/1918 | Flannery | 187/71 |
| 1,301,924 | 4/1919 | Evangelist | 187/71 |
| 1,373,122 | 3/1921 | Evangelist | 187/71 |
| 3,645,519 | 2/1972 | Schwarz et al. | 187/71 X |
| 3,866,718 | 2/1975 | Hiergeist | 187/27 |

FOREIGN PATENT DOCUMENTS

| | | | |
|---|---|---|---|
| 2302960 | 10/1976 | France | 187/27 |
| 52-73450 | 6/1977 | Japan | 187/71 |

*Primary Examiner*—J. V. Truhe
*Assistant Examiner*—W. E. Duncanson, Jr.
*Attorney, Agent, or Firm*—Cushman, Darby & Cushman

[57] ABSTRACT

The installation comprises a switch 121 inserted between an electric source 117 and the motor 105 of a winch 104, a switch which is of the two-part type of which one 121*a* is solid with a moving contact 108 and the other 121*b* with a car 103.

The electric elements of the installation such as motor 105, electromagnets 118 and 119 and a motor 114 of a drum 110 for connecting cables 116 are fed directly by a line 200 from electric source 117 while a line 300 runs to part 121*b* of switch 121, the other part 121*b* receiving lines corresponding to feeding other poles of said electric elements 105, 118, 119, 114.

When the current is interrupted, electromagnets 118–119 are deexcited and springs 149–150 thrust levers 141–142. Car 103, thus uncoupled from moving contact 108, descends by its own weight, unwinding connecting cables 116. A centrifugal brake 112 assures a reasonable and constant speed until car 103 reaches the stop.

Even if the current is reestablished while the car is descending by itself, motor 105 cannot be started since switch 121 is open.

16 Claims, 7 Drawing Figures

SAFETY INSTALLATION FOR ELEVATORS

This invention has as its object a safety installation for elevators.

Elevator installations essentially comprise a car that moves vertically along stationary guides, a winch that is mounted at the high part of the building and which is driven by an electric motor, and carrying cables whose one end is fastened to the car and the other end to a counterweight vertically mobile along the rails, these cables being driven by winch pulleys.

These installations are associated with a safety brake which opposes the movement of the car in case of a break in the carrying cables. However, no means is provided to assure automatic movement of the car in case of power failure of the winch or when the current is cut off.

Now, as a result of the current being cut off, the car can be stopped between two floors and the occupants are trapped until specialists come to operate the winch manually to bring the car to a landing where the passengers can leave.

Making of installations in which the carrying cables are fastened to the upper part of the car on a winch able to be operated from inside the car have been thought of. Thanks to this arrangement, it is possible, in case of a cutoff of the power to the electric motor, to operate the winding of the traction cable on the car winch to move the elevator to a landing.

Such a device is described in Swiss Pat. No. 207,119 which provides organs for coupling the car to a yoke that normally stays in active position and on which physical force has to be exerted by a handle located inside the car to move them in retracted position. The car remains hooked to the yoke during normal operation and is separated when a positive action is exerted on the handle.

This system offers no safety particularly in case the electric current is reestablished while the car is moved by its own weight.

Further, for functioning, it assumes the presence in the car of a strong, determined, unhandicapped person. Finally, this patent does not provide any means for stopping the car at the nearest floor in case of emergency.

Belgian Pat. No. 765,031 is also known which provides movement either mechanically by a motor or manually by a crank "so that finally also a rotary movement is imparted to the drum so as to unwind in this way the wound cable, which results in making the elevator car descend in relation to the blocked supplementary unit."

This device can function only if there is a person in the car strong enough to operate the crank. The safety function therefore implies the voluntary intervention of at least a passenger in the car and assumes that this passenger knows of the existence of a safety device and how to use it.

French Pat. No. 1,336,431 also provides a deliberate action of the passengers in the car on the auxiliary drive elements which are supposed to function by replacing the usual winch.

No safety has been provided to avoid an untimely move in case the electric current is restored during emergency operations.

It can be seen that the known solutions are inconvenient and unsatisfactory. If a winch is provided that is fastened to the car and operated by a motor, independent power supply means have to be provided, which requires a very large installation. Obviously, manual means can be provided but they require either a considerable muscular effort (and it is not certain that the person in the car will be able to operate the manual means) or a very great gearing down inserted between the manual means and the winch, in which case movement of the car runs the risk of being very long.

One of the purposes of the invention is to achieve a safety installation that remedies the various drawbacks of the prior devices.

An elevator safety installation according to the invention is of the type comprising a moving contact fastened to the lower ends of the carrying cables wound on an electric winch and a car mobile along stationary guides, located under the moving contact and connected to it, on the one hand, by direct mechanical coupling organs that are mounted mobile between an active position in which they make the car rigidly solid with the moving car and a retracted position in which they are inactive and, on the other hand, by a connecting cable wound on a rotary drum placed on the car, which is suspended only from said moving contact by said cable when the coupling organs are in retracted position, and is characterized in that it is provided with means for automatic uncoupling of the moving contact and car, means comprising an electric circuit which is connected to the same power source as the one supplying the winch circuit and which comprises, on the one hand, at least an electromagnet associated with the coupling organs and mounted so that it has to keep said organs in active position as long as it is excited by the electric current flowing normally, while it must release them as soon as the current is no longer supplied and therefore the electric current no longer flows and, on the other hand, by a switch placed between the power source and winch and mounted so that it automatically remains in closed position as long as the coupling organs are in the active position and is automatically put in open position as soon as said organs are in retracted position, these coupling organs being associated with mechanical means opposing the electromagnet but with less force and which constantly pull these organs toward their retracted position.

Thanks to these arrangements, when the elevator car is stopped between two floors because of an interruption of the electric power, the car is automatically uncoupled from the moving contact and goes down to the lower floor so the passengers can leave the car.

Other additional characteristics of the invention will come out from the detailed description below given with reference to the accompanying drawing. Of course, the description and drawing are given only by way of indicative and nonlimiting example.

Figure 1:
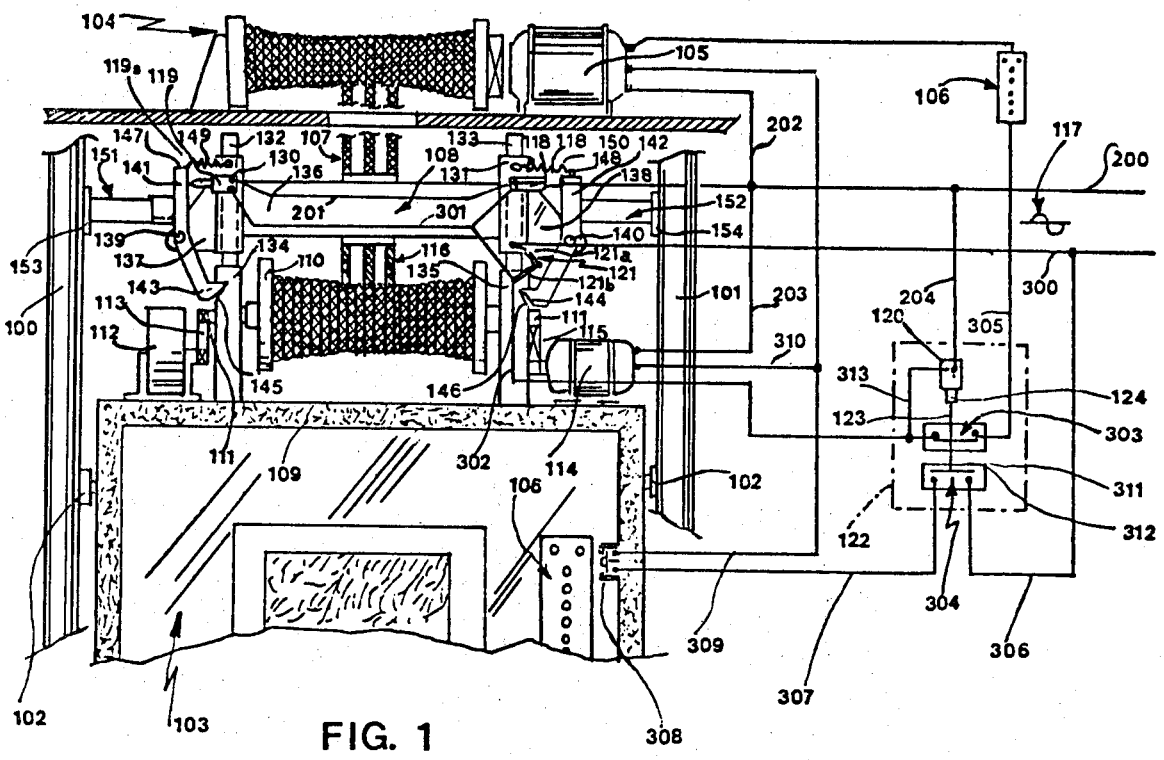
FIGS. 1 and 2 are diagrammatic views showing an installation according to the invention, on the one hand, in the normal operating situation and, on the other hand, in case of interruption of the electric current.
Figure 2:
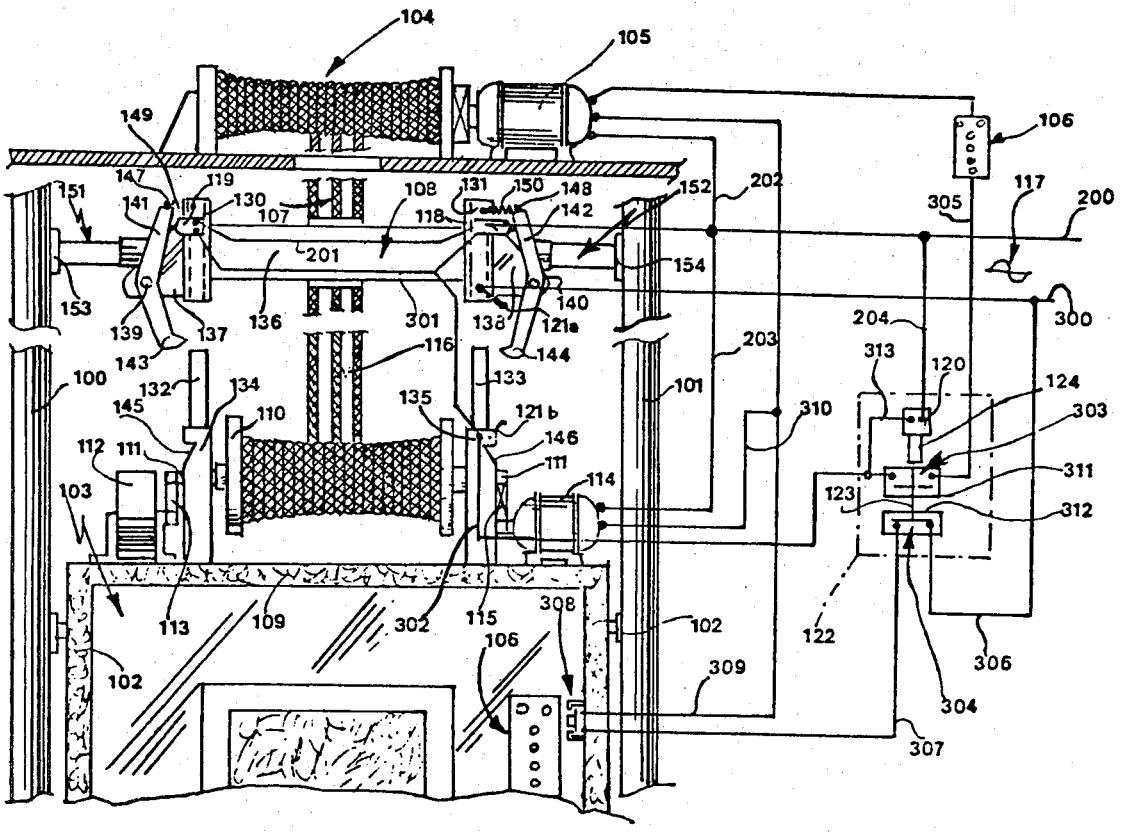

Referring to FIGS. 1 and 2, it can be seen that an installation according to a first embodiment of the invention comprises, as is known in se, vertical guides 100 and 101 made, for example, of pipe and with which shoes 102 work, which, of known type, are solid with elevator car 103.

The invention also comprises a winch 104 driven by an electric motor 105 with insertion of mechanisms of any known type such as reducers, clutches, etc.

Motor 105 is controlled by a set of control buttons 106 located on the inside of car 103 and making it possible to choose the desired floor, as is well known.

Carrying cables 107 wind on winch 104; their free end is fastened to a moving contact 108 and the other end associated, by any known means, with a counterweight (not shown).

Moreover, on roof 109 of car 103 there is mounted to rotate a drum 110 whose shaft 111 is associated, on the one hand, with a centrifugal braking device 112 by a kinematic link 113 and, on the other hand, to an electric motor 114 by a kinematic link 115.

Connecting cables 116, which lead to the lower part of moving contact 108, are wound on drum 110.

The various electric elements of the installation such as winch motor 105, control buttons 106, lighting of the car and its various auxiliaries such as the alarm bell, etc., are supplied from an electric power source 117 represented symbolically here and comprising only two lines 200 and 300 respectively. Naturally, in practice, such an electric installation can be a different type and particularly a three-phase type with ground wires, etc.

Line 200 goes directly to a pole of an electromagnet 118 and by a line 201 to a pole of another electromagnet 119. Naturally, there could be only one electromagnet and, on the contrary, there could be more than two. In this last hypothesis, line 200 comprises as many extensions 201 as there are electromagnets to excite, besides the first one 118.

By shunts 202 and 203, respectively, line 200 is connected directly to one of the poles of electric motor 105, on the one hand, and to one of the poles of electric motor 114, on the other hand. Finally, a shunt 204 connects line 200 to one of the poles of a control electromagnet 120 of any known type able to actuate two contacts as will be described below.

According to one of the characteristics of the invention, switch 121, placed between source 117 and motor 105 of winch 104, is of the two-part of which one **121*a* is solid with moving contact 108** and the other 121*b* with car 103, switch 121 being closed when parts **121*a* and 121*b* work together and open when parts 121*a* and 121*b*** are separated.

Thus, line 300 is connected directly to part **121*a* while the rest of the installation is connected to part 121*b*** as follows:

A line 301 connects part **121*b* to the poles of electromagnets 118 and 119 other than those supplied by lines 200 and 201**.

A line 302 goes to a relay box 122 in which two contactors 303 and 304 respectively are located.

Line 302 goes to one of the poles of contactor 303, while to the other pole of said contactor 303 is connected a line 305 going to electric motor 105 of winch 104.

To one of the poles of contactor 304 goes line 306 connected directly to line 300 while to the other pole a line 307 goes to one of the poles of a switch, preferably a push button switch 308, whose other pole receives a line 309 going directly to another pole of electric motor 105 and which receives a shunt 310 going to one of the poles of electric motor 114.

Contact strips 311 and 312, respectively, of contactors 303 and 304 are solid with a rod 123 fastened to the core of an electromagnet 120.

One of the poles of electromagnet 120 is connected by line 204 to line 200, as said above, while its other pole is connected to line 302 by a shunt segment 313.

It can be seen, according to the invention, that the installation comprises means (306-304-307-308-309) to control the descent of moving contact 108 for it to become solid with car 103 after the breakdown has been repaired or electric power restored.

It can also be seen, that, according to the invention, the installation comprises an electric motor 114 to control rewinding of the connecting cable or cables 116 on drum 110 during descent of moving contact 108 for it to become solid with car 103, after the breakdown has been repaired or electric power restored.

The installation is further characterized in that it comprises an electric supply current 309 of winch 105 when car 103 and moving contact 108 are uncoupled, a switch 308 simultaneously to close the current of electric motor 114 for rewinding connecting cable or cables 116 on drum 110 and to close the electric circuit of winch 105, but only in the direction of the descent of moving contact 108 and a limit switch 304 to open the circuit of switch 308 when moving contact 108 and car 103 have been recoupled.

According to a particular embodiment of the invention, one of the poles of source 117 is connected directly by lines 200,201, 202 and 203 to one of the poles of motor 105 of winch 104, to one of the poles of the electromagnet, respectively of each electromagnet 118-119 and to one of the poles of motor 114 (when the latter is present as in FIGS. 1 and 2) connected to drum 110 and in that the other pole of source 117 is connected by a line 300 to one of the parts **121*a* of switch 121, while the other part 121*b* of said switch 121 is connected by line 301 to the other pole of the electromagnet, respectively of each electromagnet 118–119, and by a line 302 to a relay box 122 whose output is connected by a line 305 to the other pople of motor 105 of winch 104**.

The invention is also characterized in that relay box 122 comprises two contactors subjected to an organ (here electromagnet 120, its core 124 and rod 123) sensitive to the effective flow of current so that the first contactor 303 is closed when the current flows while second contactor 304 is open and conversely first contactor 303 is open and second contactor 304 closed when the current is interrupted, first contactor 303 being placed after switch 121 which is placed between source 117 and motor 105 of winch 104 and ahead of motor 105 while second contactor 304 is placed between line 300 connecting source 117 to one of the parts **121*a* of switch 121 and to a first pole of a reset contactor, preferably push button, 308 whose second pole is connected by a line 309 to a circuit of motor 105 of winch 104 established to cause rotation of this latter in only the direction corresponding to the unwinding of carrying cables 107**.

The invention is also characterized in that drum 110, placed on roof 109 of car 103 and which receives at least a connecting cable 116, is associated with an electric motor 114 whose one pole is connected directly by a line 203 to one of the poles of source 117 and whose other pole is connected by a line 310 to line 309 which goes from the second pole of reset contactor 308 to the circuit of motor 105 of winch 104 established to cause the rotation of this latter in the direction corresponding to unwinding of carrying cables 107, said motor 114 associated with drum 110 having a supply circuit established to cause rotation of drum 110 in only the direction corresponding to winding of the carrying cable or cables 116, motor 105 of winch 104 and motor 114 of drum 110 further being synchronized.

Functioning of the installation that has just been described is as follows:

When source 117 normally supplies lines 200 and 300, the current normally arrives by lines 200, 201, 202 and 203 respectively to electromagnets 118 and 119, motor 105 of winch 104 and to motor 114.

Moving contact 108 is solid with car 103 by means that will be described below so that switch 121 is closed since its two parts 121*a* and 121*b* are in contact with one another.

The current arriving by line 300 flows through switch 121 and feeds line 307 to the other poles of electromagnets 118 and line 302 to relay box 122.

Electromagnet 120 is excited since it receives current, on the one hand, by line 204 and, on the other hand, by shunt 313 so that core 124 is attraction position whereby strip 311 close first contactor 303 while strip 312 is separated from the poles of second contactor 304 which is thus open.

The closed position of contactor 303 results in motor 105 of winch 104 being able to be fed when there is actuated one of the floor selection buttons of unit 106 which has been represented here on line 305 but which could also be inserted in line 202.

This installation therefore functions like all existing ones, as long as the electric current arrives normally.

Before describing the operations that occur automatically when the current is interrupted, there will now be described by way of nonlimiting example the means whereby moving contact 109 and car 103 are made positively solid with one another.

Moving contact 108 comprises vertical tubes 130 and 131 in which can be engaged, with free sliding, central cores 132 and 133, also cylindrical, which are solid with supports 134 and 135 fastened on the roof 108 of car 103.

To tubes 130, joined together by a strong piece 136, are fastened, for example by welding, supports 137 and 138, respectively, of pivots 139 and 140 on which levers 141 and 142 are mounted to pivot.

In their lower part, levers 141 and 142 are provided with solid hooks 143 and 144 able to be engaged in notches 145 and 146 provided on supports 134 and 135 solid with roof 109 of car 103.

In the upper part, levers 141 and 142 are provided with a hooking organ 147 and 148 for a powerful spring 149 and 150 which is stretched between this hooking organ 147–148 respectively and similar organs fastned on tubes 130 and 131 of moving contact 108.

Electromagnets 118 and 119 are fastened on tubes 130 and 131 so that their plunger core 118*a* and 119*a*, respectively, is placed opposite levers 141 and 142, as close as possible to their upper end.

Springs 149 and 150 are so placed that they constantly exert a force on levers 141 and 142 to bring their upper end to tubes 130 and 13 which results in moving hooks 145 and 146 from one another, i.e., pulling them toward their uncoupling from notches 145 and 136, which corresponds to release of car 103 in relation to moving contact 108.

When electromagnets 118 and 119 are excited they have their cores 118*a* and 119*a* in extraction position and these electromagnets 118 and 119 have been made with such a power that their force is greater than that, which is opposite, of springs 149 and 150.

Having described this example of making the organs for making car 103 and moving contact 108 rigidly solid with one another, there will now be described the operations that follow upon interruption of the electric current.

In this hypothesis, the absence of current particularly affects electromagnets 118 and 119 whose cores 118*a* and 119*a* are energetically recalled, by any known means, to their retracted position so that, under the effect of springs 149 and 150, levers 141 and 142 pivot around shafts 139 and 140 and hooks 143 and 144 leave notches 145 and 146.

Car 103 no longer being hooked to moving contact 108 by hooks 143 and 144, car 103 continues to descend, while contact 108 stays blocked because motor 105 of winch 104 has stopped for lack of current.

Descent of car 103 is braked by centrifugal device 112 so that the speed of descent remains reasonable and occurs practically without a jerk for the passengers of car 103 who in practice perceive the interruption of current only by the lights going out, since the operation of releasing the car is done entirely automatically and without any intervention of the passengers.

Thus, it can be seen, in FIG. 2, that the car continues to descend at a constant speed thanks to centrifugal brake 112 until it meets the stops arranged in association with springs that are at the bottom of the elevator shaft, so that stopping of car 103 occurs without any roughness and without any deterioration.

The passengers of car 103 can then use the door which is placed in front of car 103 and which, if necessary, is opened manually with a key as is known in se.

Interruption of the electric current also results in eliminating the excitation of electromagnet 120 whose core 124 is automatically in extraction position so that rod 123 has shoved strips 311 and 312 so that the first has separated the poles of contactor 303 while the second has closed contactor 304 by putting the poles of said contactor in contact.

Thus FIG. 2 represents a position of the installation corresponding to interruption of electric current and in this situation the operations following return of the electric power occur.

When the current is reestablished, the installation unit is isolated as a result of opening of switch 121 since its part 121*a* remains solid with the moving contact while the other part 121*b* is solid with support 135 that is fastened to car 103.

But the position of electromagnet 120, in case it is not supplied, corresponds to opening of contactor 303 and, simultaneously, to closing of contactor 304.

Thus, although current arrives directly by lines 200, 201, 203, 204 to electromagnets 118 and 119, on the one hand, to motor 105 of winch 104, on the other hand, and to motor 114 of drum 110, none of these elements can be fed since opening of switch 121 and opening of contactor 303 interrupts the current that could arrive by line 300.

However, line 306, connected directly to line 300, brings current by closed contactor 304 to one of the poles of reset contactor 308 whose other pole is connected by lines 309 and 310 to motor 105 of winch 104 and to motor 114 of drum 110.

Thus, when the current is reestablished, it suffices to press on the push button of reset contactor 308 to cause, simultaneously, supplying of motor 105 of winch 104 and of motor 114 of drum 110.

But line 309 runs to a circuit that is so laid out that motor 105 can turn only in the direction of unwinding of carrying cable 107 which corresponds to descent of moving contact 108 to meet car 103 that is immobile at the bottom of the installation.

Simultaneous rotation of motor 114 has the effect of causing rotation of drum 110 only in the direction corresponding to winding of connecting cables 116, synchronization between motor 105 and 114 having the effect that connecting cables 116 wind on drum 116 as moving contact 108 approaches car 103.

At any moment, this movement can be interrupted when pressure on the push button of reset contactor 308 is relaxed but if it is continued, approach of moving contact 108 and car 103 goes on until return to the positive position, as will be explained below.

First, it is noted that according to a characteristic of the invention, moving contact 108 comprises a central part (here formed by piece 136, tubes 130, 131 and supports 137, 138) which is equipped with lateral arms 151 and 152 whose ends 153 and 154 work with stationary guides 100 and 101 and which are preferably adjustable in length to be fitted to different spacing of guides 100 and 101 according to preexisting installations.

FIGS. 1 and 2 show, by way of example, an embodiment whereby arms 151 and 152 are made up of two telescopic parts immobilized in relation to one another by any known means, such as radial screws, when the correct spacing is obtained.

According to another characteristic of the invention, the central part (made up as said above) by moving contact 108 in provided with vertical guides 130 and 131 with which counterparts 132 and 133 solid with car 103 are supposed to work so that the relative position of said moving contact 108 and said car 103 will be suitably determined laterally when guides 130 and 131 and their counterparts 132 and 133 work together.

Thus, then, at the moment car 103 is approached by moving contact 108 which descends as said above, counterparts 132 and 133 go into guides 130 and 131 to assume a perfect lateral alignment of car 103 and the accessories it carries, on the one hand, moving contact 108 and of the accessories it carries, on the other hand.

It is thus assured that the two parts 121*a* and 121*b* of switch 121 will be perfectly opposite one another. When this switch is closed by application of the two parts 121*a* and 121*b* against each other, electromagnets 118 and 119 will instantly be reexcited so that their plungers will be put in extraction position and they will make levers 141 and 142 pivot around pivots 139 and 140 against the action of springs 149 and 150 which will again be put under tension, hooks 143 and 144 being engaged in notches 145 and 146 of supports 134 and 135.

Simultaneously, the current going through line 302 will reach electromagnet 120 which, by changing position, will at the same time cause closing of contactor 303 and opening of contactor 304 so that even if inadvertently pressure is continued on the push button of reset contactor 308, feed to motors 105 and 114 is automatically interrupted and moving contact 108 is stopped.

The installation has then returned automatically to the situation represented in FIG. 1 and the elevator can again be made to function by pressing on one of the floor selection buttons of unit 106.

It is found that, according to the invention, no human intervention is necessary other than that consisting in causing moving contact 108 and car 103 to become solid after the breakdown is over.

Restoration of the installation to its original state for normal functioning is done without car 103 being put in motion so that no accident can occur, especially if the precaution has been taken, as shown in the drawing, to place reset contactor 308 in car 103 itself so that the one in charge of this function easily sees if the situation is normal in regard to the landing especially and if nothing opposes restoring the installation.

Figure 3:
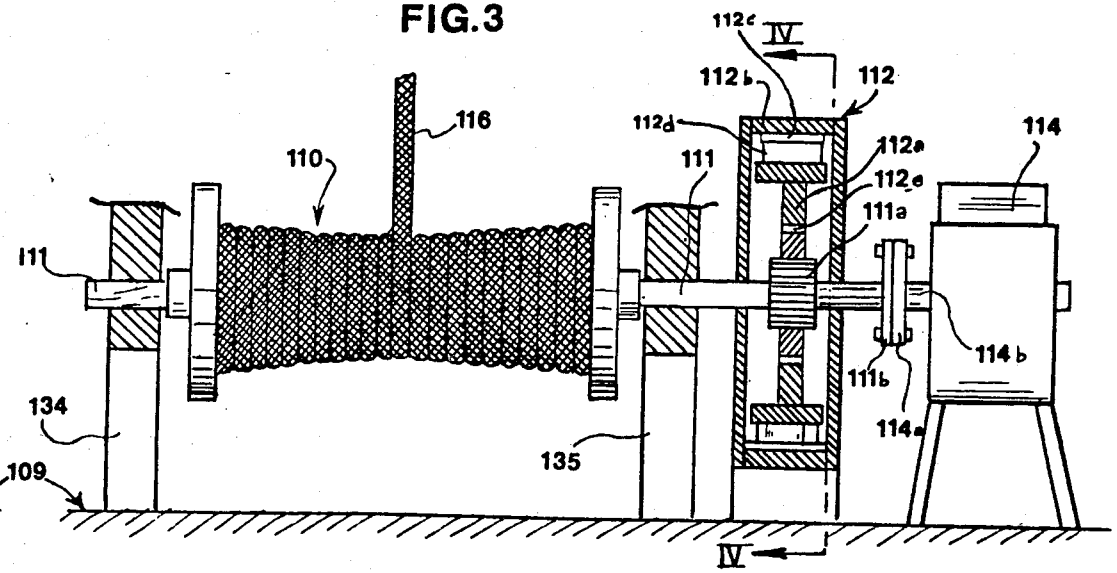
FIG. 3 is a diagrammatic view in section showing an example of embodiment of the drum-brake-motor unit.
Figure 4:
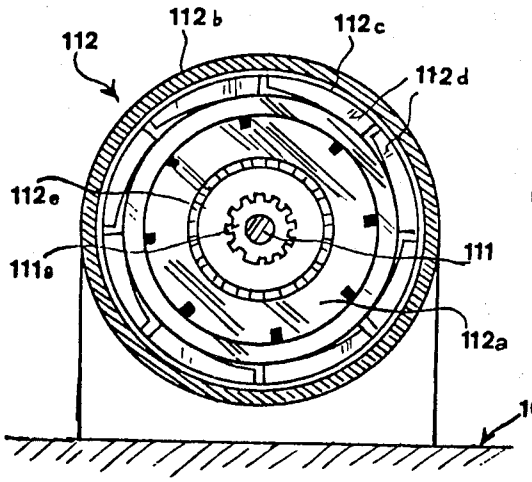
FIG. 4 is a view in section of the brake, made along line IV—IV of FIG. 3.

FIGS. 3 and 4 show an embodiment of the drum 110-centrifugal brake 112-motor 114 unit. According to this example, shaft 111 comprises a fluted part 111*a* and its free end is solid with a flange 111*b* intended to be coupled with a flange 114*a* keyed on drum shaft 114*b* of electric motor 114.

Fluted part 111*a* works with plate 112*a* of an inertia brake 112 comprising a stationary drum 112 with whose inside surface can work friction linings 112*c* carried by flexible blades 112*d* fastened to the periphery of plate 112*a*.

Plate 112*a* comprises a free wheel 112*e* made so that when connecting cable 116 unwinds, shaft 111 drives plate 112*a*, while plate 112*a* remains stationary when cable 116 winds on drum 110, thanks to the action of electric motor 114.

It can be seen that as soon as cable 116 tends to unwind, shaft 111 will drive drum 112*a*, and by centrifugal force, friction lining 112*c* will be applied against the inside surface of stationary drum 112*b*.

The embodiment that has been described with reference to FIGS. 1 and 2 provides that at the moment of interruption of the electric power supply, car 103 descends (being braked by centrifugal drive 112) to the lowest floor of the installation so that if the interruption of current occurs at the time when the car is at a high floor, a very great length of cable 116 must be provided and consequently the presence of an electric motor 114 is essential to assure the number of turns necessary for complete winding of such a length of cable.

According to a characteristic of the invention, the installation comprises means to block car 103 in case of breakdown or cutoff of electric power to motor 105 of winch 104, opposite the landing directly below the location of accidental stopping of car 103.

According to a particular embodiment, the means to block car 103 in case of breakdown and cutoff of power to motor 105 of winch 104 opposite the landing located directly below the location of the accidental stopping of car 103 comprise stops 160 provided along guide 100–101 and electromagnetic bolts 163–164 carried by car 103 and intended to work with said stops 160.

According to a variant, the installation comprises an electric switch 121 to open the circuit supplying winch 105 and to open the circuit supplying electromagnetic bolts 163 and 164 when car 103 and moving contact 108 are uncoupled so that they remain in active position as long as moving contact 108 and car 103 are uncoupled, a second electric circuit 306-304-307-308-309 to control winch 105 only in the direction of descent of moving contact 108 and a limit switch 304 to open the second electric circuit when moving contact 108 and car 103 have been recoupled.

Figure 5:
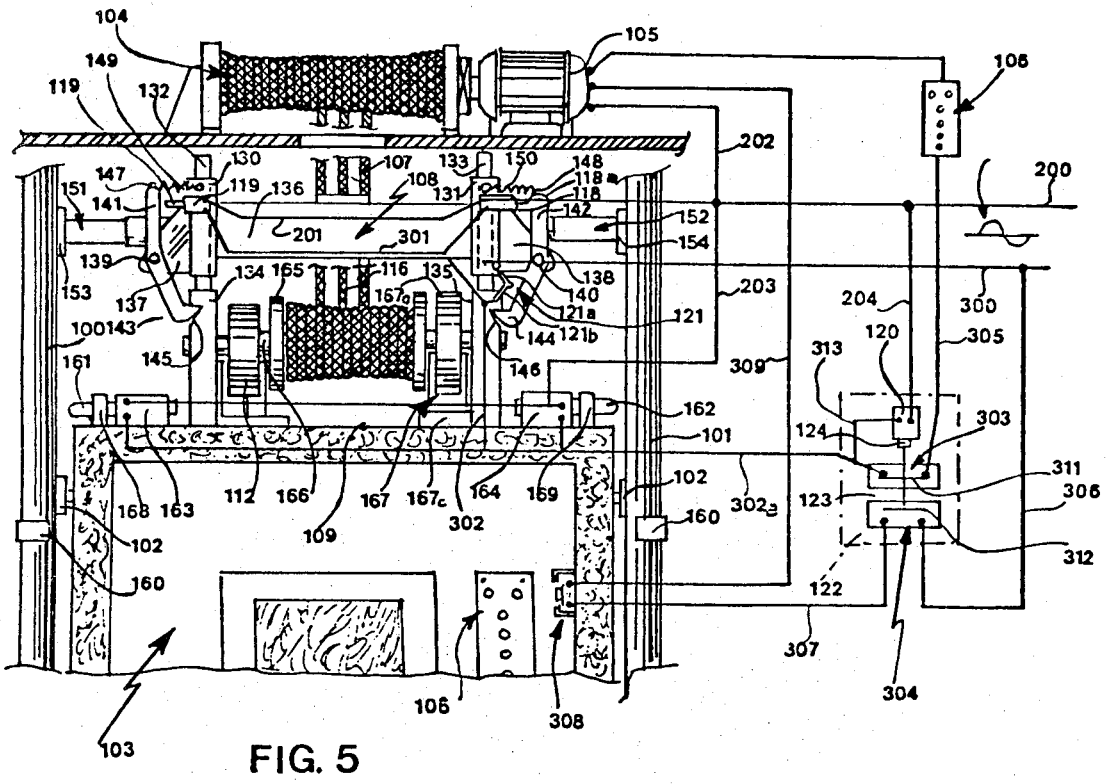
FIGS. 5 and 6 are views similar to FIGS. 1 and 2 but according to an embodiment of the invention that provides for the car to stop at the floor immediately below, in relation to the place where the car is located when an interruption of current occurs.
Figure 6:
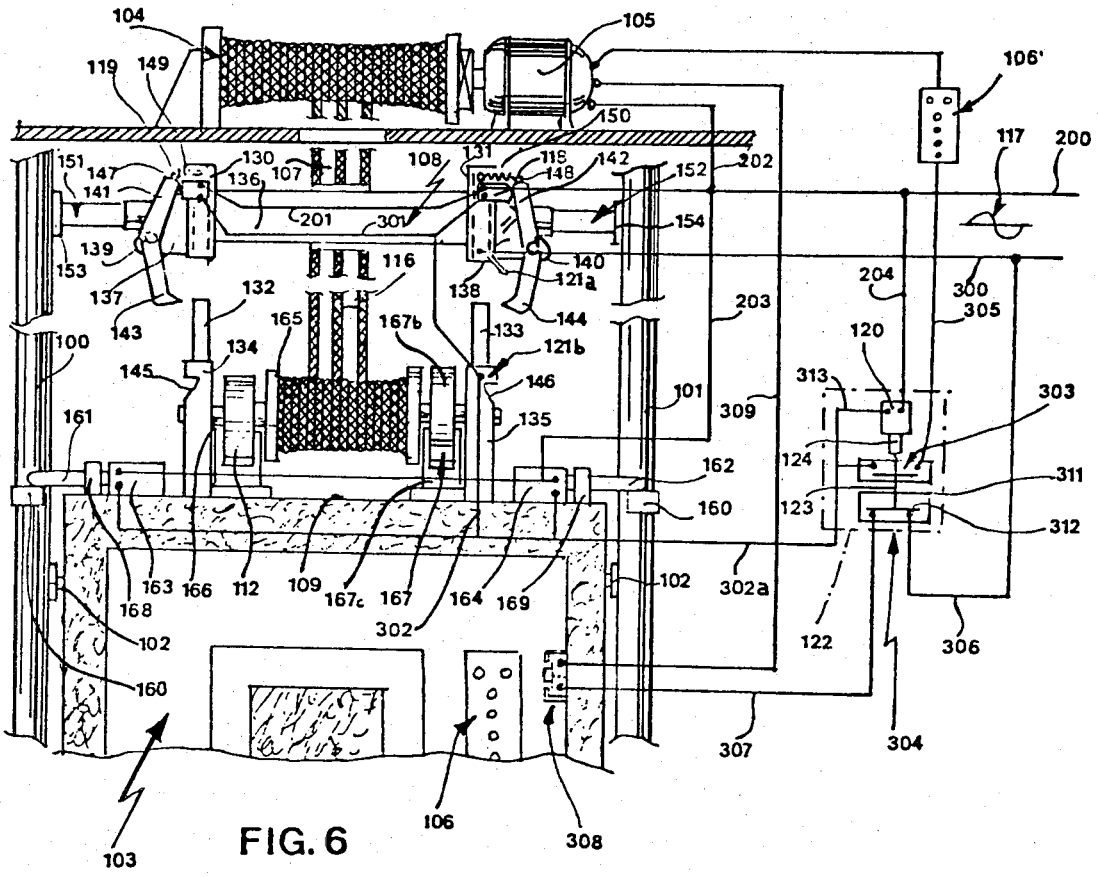

FIGS. 5 and 6 show such an embodiment of the invention whereby car 103 is automatically stopped at the floor located immediately below the place where this car 103 is separated from moving contact 108.

Referring to these figures, it can be seen that the installation comprises parts common with that shown in FIGS. 1 and 2, these common parts being designated by the same references.

It can be seen that stationary guides 100 and 101 receive stops 160 which are solidly fastened on guides 100 and 101 and with which work moving parts 161 and 162 of electromagnetic bolts 163 and 164 fastened on roof 109 of car 103.

This embodiment provides a length of cable 116 shorter than in the embodiment of FIGS. 1 and 2.

For this reason, here, connecting cable 116 winds on small-sized drum 165 whose shaft 166 is associated, on the one hand, with a centrifugal braking device 112 and, on the other hand, a spring drum 167.

Figure 7:
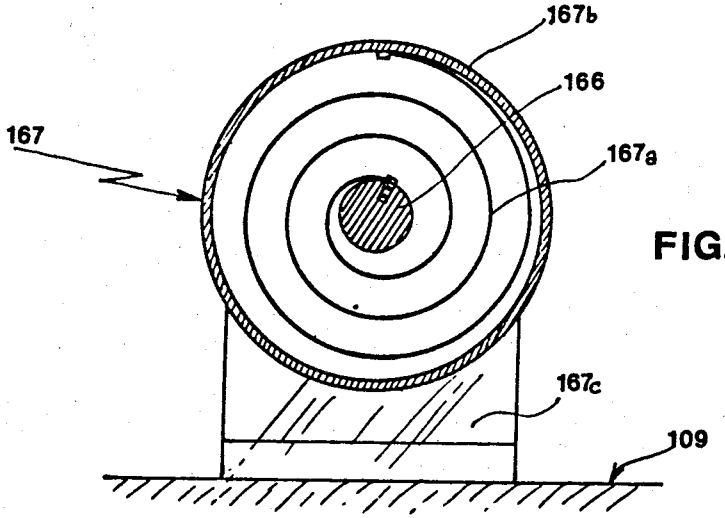
FIG. 7 is a diagrammatic view in section of a spring drum for winding the connecting cables.

It can be seen in FIG. 7 that one of the ends of shaft 166 is solid with one of the ends of a coil spring 167*a* whose other end is solid with a cage 167*b* fastened to a support 167*c*. Coil spring 167*a* tends to make drum 165 turn so as to cause winding of connecting cables 116.

With this embodiment, line 200 runs by lines 201, 202 and 203, respectively, to electromagnets 118 and 119, motor 105 of winch 104 and to one of the poles of electromagnetic bolts 163 and 164.

For it part, line 300 is connected directly to part 121*a* of switch 121.

According to another characteristic of the invention, one of the poles of each electromagnetic bolt 163 and 164 is connected directly by lines 200 and 300 to one of the poles of source 117 while the other pole of each electromagnetic bolt 163 and 164 is connected to the other pole of source 117 by a line 302 connected to part 121*b* of switch 121 solid with car 103.

According to another characteristic of the invention, part 121*b* of switch 121 which receives line 302 connected to the other pole of electromagnetic bolts 163 and 164 also receives a line 301 connected to the other pole of the electromagnetic, respectively of each electromagnet 118 and 119, and a line 302*a* connected to first contactor 303 of relay box 122.

Functioning of this installation is as follows:

When source 117 normally feeds the installation, the latter is in the situation shown in FIG. 5 where it can be seen that, as in the preceding embodiment, car 103 and moving contact 108 are solid and held together by the mechanical elements consisting of hooks 143 and 144, on the one hand, and notches 145 and 146 of supports 134 and 135, on the other hand.

Switch 121 is closed so that electromagnets 118 and 119 are excited and thrust levers 141 and 142 against the action of springs 149 and 150.

Further, the current goes through closed switch 121 to reach, by line 302, the poles of electromagnetic bolts 163 and 164 other than those supplied directly by line 203. Thus, electromagnetic bolts 163 and 164 are excited, which has the effect of keeping moving elements 161 and 162 in retracted position whereby they can go past stops 160 fastened to vertical guides 100 and 101 without coming in contact with these stops, which corresponds to normal functioning of the elevator.

When electric power is interrupted and consequently the current no longer normally arrives by lines 200 and 300, moving contact 108 stays blocked where it is since motor 105 is stopped, while car 103 descends after uncoupling as described above, so that connecting cables 116 unwind and drive in rotation drum 165 which, by its shaft 166, drives, to tighten it, spring 167*a* contained by cage 167*b* of spring drum 167.

As soon as switch 121 is open, electromagnetic bolts 163 and 164 are no longer excited, so that moving parts 161 and 162 are instantly pulled, by any known means, to the extraction position shown in FIG. 6 so that stationary stops 160 are in the path of moving elements 161 and 162.

As soon as the latter strike stops 160, car 103 is blocked and, as it were, hooked to stops 160 by moving parts 161 and 162 of electromagnetic bolts 163 and 164.

Therefore, these organs have to be very strong and, by way of example, FIGS. 5 and 6 show cradles 168 and 169 passed through by moving elements 161 and 162 and which contribute to the strength of the unit by reducing the lever arm resulting from the overhang of elements 161 and 162 on stops 160.

Naturally, other mechanical solutions can be adopted, particularly oblique buttressing stops eliminating the overhang effect.

Stops 160 are fastened to stationary guides 100 and 101 at such a height that the floor of car 103 is exactly at the same level as the floor of the landing where electromagnetic bolts 163 and 164 are in the active position shown in FIG. 6.

As above, the absence of current in the installation has the effect of deexciting electromagnet 120, which causes opening of contactor 303 and closing of contactor 304.

When the current is reestablished, the actions described above are followed, i.e., reset contactor 301 is acted on which permits supplying of motor 105 by line 309 by a circuit that imposes the direction of rotation corresponding to unwinding of carrying cables 107 so that moving contact 108 is lowered to car 103 which remains immobile.

Cables 116 automatically wind around drum 165 because the latter is driven in rotation by spring 167*a* previously under tension inside of spring drum 167 and which slackens, coming back to its natural position.

As soon as the various organs are in the position corresponding to making car 103 and moving contact 108 solid, switch 121 is closed and the current flows again to excite electromagnets 118 and 119, on the one hand, and electromagnetic bolts 163 and 164, on the other hand, so that moving parts 161 and 162 come back to their withdrawn position shown in FIG. 5.

Simultaneously, electromagnet 120 has put contactor 304 back in its open position and contactor 303 is in its closed position so that finally the installation is in a situation to be used normally.

Since the length of connecting cables 116 is figured to allow car 103 to separate from moving contact 108 a length approximately equal to that of one floor, it is essential that stops 160 be provided for each floor of a given building, exception being made for the last floor.

The lowest floor corresponds to the one where the elevator pit is located and in which the spring shock absorbers are found.

According to the invention, it is possible to provide stops corresponding to this lower stage either as shown in FIGS. 5 and 6 by placing them along stationary guides 100 and 101 at a place that corresponds to the high part of car 103 or placing them in the vicinity of the shock absorbers to limit the travel of car 103, particularly to prevent its unavailability in case of overload. Actually, there are installations that provide that even a passenger overload of the car when the latter is at the lowest floor causes not a simple warning such as an alarm signal but the equivalent of a real breakdown which requires the intervention of the one responsible to restart the elevator.

By providing stops, as said above, this drawback is avoided, while functioning of the alarm signal is allowed.

It is also possible to provide that an overload of the car causes the emission of an electric signal that can be used from relay box 122 to cause, deliberately, the blocking of the car opposite a landing door, although there is no uncoupling between car 103 and moving contact 108, to obtain an effect opposite to what was set forth above, namely, the equivalent of a breakdown of the installation requiring the intervention of the one responsible, for example, by activating reset contactor 308, radically to prevent any functioning of the overload elevator.

The invention was described above according to two embodiments, one in the case of interruption of electric power, the other in case of a mechanical breakdown.

When such a mechanical breakdown occurs, particularly at electric motor 105 or its kinematic connection with winch 104, the current continuing to come from source 117, the safety system does not function and car 103 can remain between two floors.

To avoid this drawback, it is possible to provide, accessorily, that a control button located in the car artificially causes an electric failure, for example, by opening a switch placed in line 200 to create conditions for uncoupling car 103 from moving contact 108 which comes down to obtaining functioning of the installation independently of the usual machinery and consequently to allowing the passengers to reach a landing and leave the car despite blocking of moving contact 108 due to a mechanical breakdown of motor 105 or winch 104, etc.

It is possible, for example, to provide this functioning automatically when the alarm button is pushed which is part of unit 106, already known in se, to keep the functioning of the installation from being subject to an initiative that is peculiar and new to the habits already long acquired by all elevator users.

Actually, even if a person presses on this alarm button when there is no electric or mechanical failure, the result can only lead to greater safety since in any case car 103 is brought to a door allowing the passengers to leave the car regardless of the event that caused the passenger to press the alarm button.

The mechanical means, allowing car 103 and moving contact 108 to be made solid, which have been shown here as levers 141 and 142 provided with hooks 143 and 144 can be replaced by any other mechanical system regardless of its design and kinematics, because the variant selected here is intended merely to give an example of simple embodiment and can, of course, be replaced by any other equivalent within the understanding of a man of the art.

Springs 149 and 150 can also be replaced by equivalents.

But, according to a characteristic of the invention, mechanical means opposing the electromagnet, respectively each electromagnet 118-119, consist of the weight of car 103 itself which acts toward uncoupling.

It is possible then, except for the excess weight of car 103, to provide holding car 103 and moving contact 108 in solid position by the electromagnets themselves.

The design of electromagnet bolts 163 and 164 and the braking or retarding mechanisms can also be modified to meet the needs of each case, which are within the understanding of a man of the art.

Switch 121 can also be of a type different from the one shown here only by way of example and it would be possible, particularly, to provide that one of the two parts of the switch consists of a group of studs and is solid with either car 103 only or moving contact 108 only, while the other part of switch 121 consists of an element that assures contact between the studs and closes the circuit when car 103 and moving contact 108 are in solid position.

It would also be possible to use any electric or electronic equivalent such as a photoelectric cell or the like.

Finally, to allow fitting of an installation to existing buildings, adjustable telescopic arms 151 and 152 have been provided, but any other equivalent is possible, since a perfect centering of moving contact 108 is obtained even when it is uncoupled from car 103 and, therefore, is independent of the guide and centering shoes 102.

The invention therefore is not limited to only the embodiments described and shown but on the contrary takes in all variants.

I claim:

1. Elevator safety installation of the type comprising a moving contact (108) fastened to the lower ends of carrying cables (107) wound on an electric winch (105) and a car (103) mobile along stationary guides (100–101) located under the moving contact (108) and connected to it, on the one hand, by means of direct mechanical coupling organs (141–144) which are mounted mobile between an active position in which they make the car (103) rigidly solid with the moving contact (108) and a retracted position in which they are inactive and, on the other hand, by means of a connecting cable (116) wound on a rotary drum (110) placed on the car (103), which is suspended from moving contact (108) by said cable (116) when the coupling organs (141–144) are in retracted position, characterized in that it is provided with means for automatic decoupling of the moving contact (108) and car (103), means comprising an electric circuit which is connected to the same source (117) as that supplying the circuit of winch (105) and which comprises, on the one hand, at least an electromagnet (118–119) associated with the coupling organs (141–144) and mounted so that it has to keep said organs (141–144) in active position as long as it is excited by the electric current flowing normally, while it has to release them as soon as the current is no longer supplied and therefore the current no longer flows and, on the other hand, a switch (121) inserted between the source (117) and the winch (105) and mounted so that it automatically stops in closed position as long as the coupling organs (141–144) are in active position and it is automatically placed in open position as soon as said organs (141–144) are in retracted position, these coupling organs (141–144) being associated with mechanical means (149–150) opposing the electromagnet (118–119) but with less force and which constantly pull these organs (141–144) toward their retracted position.

2. Installation according to claim 1 wherein the switch (121) inserted between the source (117) and the motor (105) of the winch (104) is of the two-part type of which one (121*a*) is solid with the moving contact (108) and the other (121*b*) with the car (103), the switch (121) being closed when the parts (121*a* and 121*b*) work together and open when the parts (121*a* and 121*b*) are separated.

3. Installation according to claim 1, wherein it comprises means (306-304-307-308-309) to control the descent of the moving contact (108) for it to become solid with the car (103) after the breakdown has been repaired or electric power supply reestablished.

4. Installation according to claim 3, wherein it comprises an electric motor (114) to control rewinding of the connecting cable (116) on the drum (110) during descent of the moving contact (108) to become solid with the car (103) after the breakdown has been repaired or the electric power supply reestablished.

5. Installation according to claim 4, wherein it comprises an electric circuit (309) feeding the winch (105) when the car (103) and the moving contact (108) are uncoupled, a switch (308) to close simultaneously the circuit of the electric motor (114) for rewinding the connecting cable (116) on the drum (110) and the electric circuit of the winch (105), but only in the direction of descent of the moving contact (108) and a limit switch (304) to open the circuit of the switch (308) when the moving contact (108) and the car (103) have been recoupled.

6. Installation according to claim 5, wherein one of the poles of the source (117) is connected directly lines (220, 201, 202 and 203) to one of the poles of the motor (105) of the winch (104), to one of the poles of the electromagnet, respectively of each electromagnet (118–119) and to one of the poles of the optional motor (114) connected to the drum (110) and wherein the other pole of the source (117) is connected by a line (300) to one of the parts (121*a*) of the switch (121) while the other part (121*b*) of said switch (121) is connected by a line (301) to the other pole of the electromagnet, respectively of each electromagnet (118–119) and by a line (302) to a relay box (122) whose output is connected by a line (305) to the other pole (105) of the winch (104).

7. Installation according to claim 6, wherein the relay box (122) comprises two contactors (303 and 304) subjected to an organ (120-123-124) sensitive to the effective flow of current so that the first contactor (303) is closed when the current flows, while the second contactor (304) is open and vice versa the first contactor (303) is open and the second (304) closed when the current is interrupted, the first contactor (303) being placed after the switch (121) which is inserted between the source (117) and the motor (105) of the winch (104) and before said motor (105) while the second contactor (304) is placed between the line (300) connecting the source (117) to one of the parts (121*a*) of the switch (121) and to a first pole of a reset contactor, preferably push button (308), whose second pole is connected by a line (309) to a circuit of the motor (105) of the winch (104) designed to cause rotation of this latter in only the direction corresponding to unwinding of the carrying cables (107).

8. Installation according to claim 7, wherein the drum (110) placed on the roof (109) of the car (103) and which receives at least a connecting cable (116) is associated with an electric motor (114) whose one pole is connected directly by a line (203) to one of the poles of the source (117) and whose other pole is connected by a line (310) to the line (309) that extends from the second pole of the reset contactor to the circuit of the motor (105) of the winch (104) designed to cause rotation of this latter in the direction corresponding to unwinding of the carrying cables (107), said motor (114) associated with the drum (110) having a supply circuit designed to cause rotation of the drum (110) in the direction corresponding to winding of the connecting cable or cables (116), the motor (105) of the winch (104) and the motor (114) of the drum (110) being, in addition, synchronized.

9. Installation according to claim 1, wherein it comprises means to block the car (103) in case of breakdown or cutoff of electric power to the motor (105) of the winch (104), opposite the landing located directly below the site of the accidental stopping of the car (103).

10. Installation according to claim 9, wherein the means to block the car (103) in case of breakdown or cutoff of electric power to the motor (105) of the winch (104) opposite the landing located directly below the site of the accidental stopping of the car (103) comprise stops (160) provided along the guides (100–101) and electromagnetic bolts (163–164) carried by the car (103) and intended to work with said stops (160).

11. Installation according to claim 10, wherein it comprises an electric switch (121) to open the circuit supplying the winch (105) and to open the circuit supplying the electromagnetic bolts (163–164) when the car (103) and moving contact (108) are uncoupled, so that they remain in active position as long as the moving contact (108) and the car (103) are uncoupled, a second electric circuit (306-304-307-308-309) to control the winch (105) solely in the direction of descent of the moving contact (108) and a limit switch (304) to open the second electric circuit when the moving contact (108) and the car (103) have been recoupled.

12. Installation according to claim 11, wherein one of the poles of each electromagnetic bolt (163 and 164) is connected directly by lines (200 and 203) to one of the poles of the source (117) while the other pole of each electromagnet (163 and 164) is connected to the other pole of the source (117) by a line (302) connected to the part (121*b*) of the switch (121) solid with the car (103).

13. Installation according to claim 12, wherein the part (121*b*) of the switch (121) which receives the line (302) connected to the other pole of the electromagnetic bolts (163 and 164) also receives a line (301) connected to the other pole of the electromagnetic, respectively of each electromagnet (118 and 119).

14. Installation according to claim 1, wherein the moving contact (108) comprises a central part (136, 130-131, 137-138) which is provided with lateral arms (151 and 152) whose ends (153 and 154) work with stationary guides (100 and 101) and which preferably are adjustable in length to be fitted to the various spacings of the guides (100 and 101) depending on preexisting installations.

15. Installation according to claim 14, wherein the central part (136, 130-131, 137-138) of the moving contact (108) is provided with vertical guides (130 and 131) with which counterparts (132 and 133) solid with the car (103) are supposed to work so that the relative position of said moving contact (108) and of the car (103) is suitable determined laterally when the guides (130 and 131) and their counterparts (132 and 133) work together.

16. Installation according to claim 1, wherein the mechanical means opposing the electromagnet, respectively each electromagnet (118–119), consist of the weight of the car (103) itself which acts in the direction of uncoupling.

* * * * *